United States Patent [19]

Buckley et al.

[11] 3,979,704

[45] Sept. 7, 1976

[54] CIRCUIT BREAKER HAVING MEMBERS COATED WITH PHOSPHATE-CHROMATE PROTECTIVE LAYERS

[75] Inventors: Richard D. Buckley; John Hilko, both of Athens, Ga.

[73] Assignee: Westinghouse Electric Corporation, Pittsburgh, Pa.

[22] Filed: May 23, 1975

[21] Appl. No.: 580,507

[52] U.S. Cl. ..... 335/6; 335/196; 148/6.16; 252/389 A

[51] Int. Cl.[2] ..... H01H 75/00

[58] Field of Search ..... 335/6, 133, 196; 148/6.16; 106/14; 252/389 A; 337/75

[56] References Cited

UNITED STATES PATENTS

| | | | |
|---|---|---|---|
| 2,768,104 | 10/1956 | Schuster et al. | 148/6.16 |
| 3,706,604 | 12/1972 | Plaxton | 148/6.16 |
| 3,803,048 | 4/1974 | Hwa | 252/389 A |
| 3,860,898 | 1/1975 | Leonard | 337/75 X |
| 3,864,139 | 2/1975 | Heller | 106/14 X |

*Primary Examiner*—George Harris
*Attorney, Agent, or Firm*—D. P. Cillo

[57] ABSTRACT

A circuit breaker, operating in an insulating liquid dielectric environment, switchable between an open position and a closed position, is made of metallic sensing, tripping and supporting members, where a plurality of the members are coated with a dual protective film comprising a first layer containing zinc phosphate or iron phosphate about 0.00001 to about 0.0004 inch thick covered by an outside layer containing zinc chromate and/or zinc dichromate about 0.00001 to about 0.0004 inch thick, the protective film being resistant to the contacting liquid dielectric.

10 Claims, 4 Drawing Figures

CIRCUIT BREAKER HAVING MEMBERS COATED WITH PHOSPHATE-CHROMATE PROTECTIVE LAYERS

BACKGROUND OF THE INVENTION

This invention relates to circuit breakers, having contacting metal operating, sensing, tripping and supporting members, functioning in an insulating liquid dielectric environment; and more particularly, to circuit breakers for distribution transformers, to control moderate power distribution on feeder circuits.

Circuit breakers contain a variety of sensing and tripping members such as shafts, springs, support pins, contact arms, bridging assemblies, etc. These parts are generally made of steel. Many of them contact each other and are aligned in close tolerances. Most prior art parts have been tin plated. This provided a protective film which could be welded, did not attract dust or affect the coefficient of friction of the steel, and could be applied in a non-degradable thin build, so that dimensional tolerances could be maintained in transformer oil. However, tin plating is very expensive.

One solution was thought to be the replacement of many of these coated steel members with plastic parts. However, holding the many dimensions with the associated close tolerances required extremely accurate molding. Also, the hot oil environment in which the circuit breaker must function is less than ideal for even the best plastics, and this led to loss of calibration during transformer processing and in service. Another solution was thought to be the simple application of an oil film to the parts. Such films, however, burn off in the welding and processing operations of constructing the breaker, exposing the steel to the atmosphere with resultant corrosion upon storage. This problem was particularly acute in southern high humidity or seacoast salt air environments.

An associated problem is the introduction of water into the operating transformer oil environment, and circulation of the water through the hot oil. The water could be introduced through seal leakage after a pressure buildup, or by decomposition of cellulose in the transformer coil assembly. Such circulating water could possibly attack inadequately coated metal breaker members, even in the oil environment.

Zinc phosphate coating compositions were found to flake and rust. Coatings of zinc dichromate and reducing agents were also found not to solve corrosion resistance problems in southern or salt laden atmospheres.

U.S. Pat. No. 2,768,104 treated steel strip with zinc phosphate, followed by a chromic acid treatment which could include the application of reducing agents such as phosporic acid, phenol, glycerine, potassium iodide, sugar or triethanolamine, to provide an anchoring lacquer for paint and resins. U.S. Pat. No. 3,706,604 teaches a similar process of single step conversion coating a phosphate treated metal surface with zinc dichromate and esterifying and/or reducing fixing agents, such as butyl alcohol, ethylene glycol, triethanolamine, hexamethylol-melamine, hydroquinone and dimethylol urea, to provide an adherent layer for subsequently applied paint or a corrosion resistant barrier layer. None of these patents dealt with coating circuit breaker parts which must resist high oil temperatures and be compatible with contacting oil in a circuit breaker environment.

SUMMARY OF THE INVENTION

The above problems are solved by dual coating a plurality of metal sensing, tripping, and supporting members in a circuit breaker, operating in an insulating liquid dielectric environment, with a 0.00005 to 0.0005 inch build of a protective film. This protective film comprises a first layer comprising zinc phosphate or iron (ferrous or ferric) phosphate about 0.00001 to 0.0004 inch thick, covered by an outside layer comprising zinc chromate and/or zinc dichromate and their mixtures 0.00001 to 0.0004 inch thick. The chromate layer, which may react, etch or interlock into the phosphate layer, will also contain a fraction of chromium compounds in the +3 chromium valence state.

This dual coating is effective to resist corrosion during parts or circuit breaker storage. The dual coating does not interfere with breaker assembly welding, does not attract dust, does not adversely affect the coefficient of friction of the steel and allows maintenance of required dimensional tolerances. Most importantly, the dual coating is compatible with and does not contaminate insulating oil and is not degraded by hot insulating oil in a circuit breaker environment.

BRIEF DESCRIPTION OF THE DRAWINGS

For a better understanding of this invention, reference may be made to the preferred embodiments exemplary of the invention shown in the accompanying drawings, in which.

DESCRIPTION OF THE PREFERRED EMBODIMENTS

This invention relates to an oil filled transformer having a circuit interrupter disposed within the transformer housing. The circuit interrupter utilizes a bridging contact movable between an open position, spaced from a pair of stationary contacts, wherein the electrical connections through the transformer are open; and a closed position, wherein the electrical connections through the transformer are closed, engaging the stationary contacts, to complete a series circuit.

The bridging contact is spring biased towards the open position, away from the stationary contacts; but when the circuit interrupter is closed, the bridging contact is held in engagement with the pair of stationary contacts by a latching means. The latching means is movable between this latched position and an unlatched position, allowing the bridging contact to move away from the stationary contact in response to the spring bias means.

A bimetal actuating means, which is in series in the circuit, is connected so that when current flowing therethrough exceeds an overload trip level, the bimetal actuating means cooperatively associataed with the latch moves the latch to an unlatched position, permitting the circuit interrupter to trip open. The bimetal is responsive to the temperature of the surrounding oil and will deflect when the oil is heated. A majority of the operating members of the circuit interrupter or breaker will be protected with the dual coating of this invention.

Figure 1:
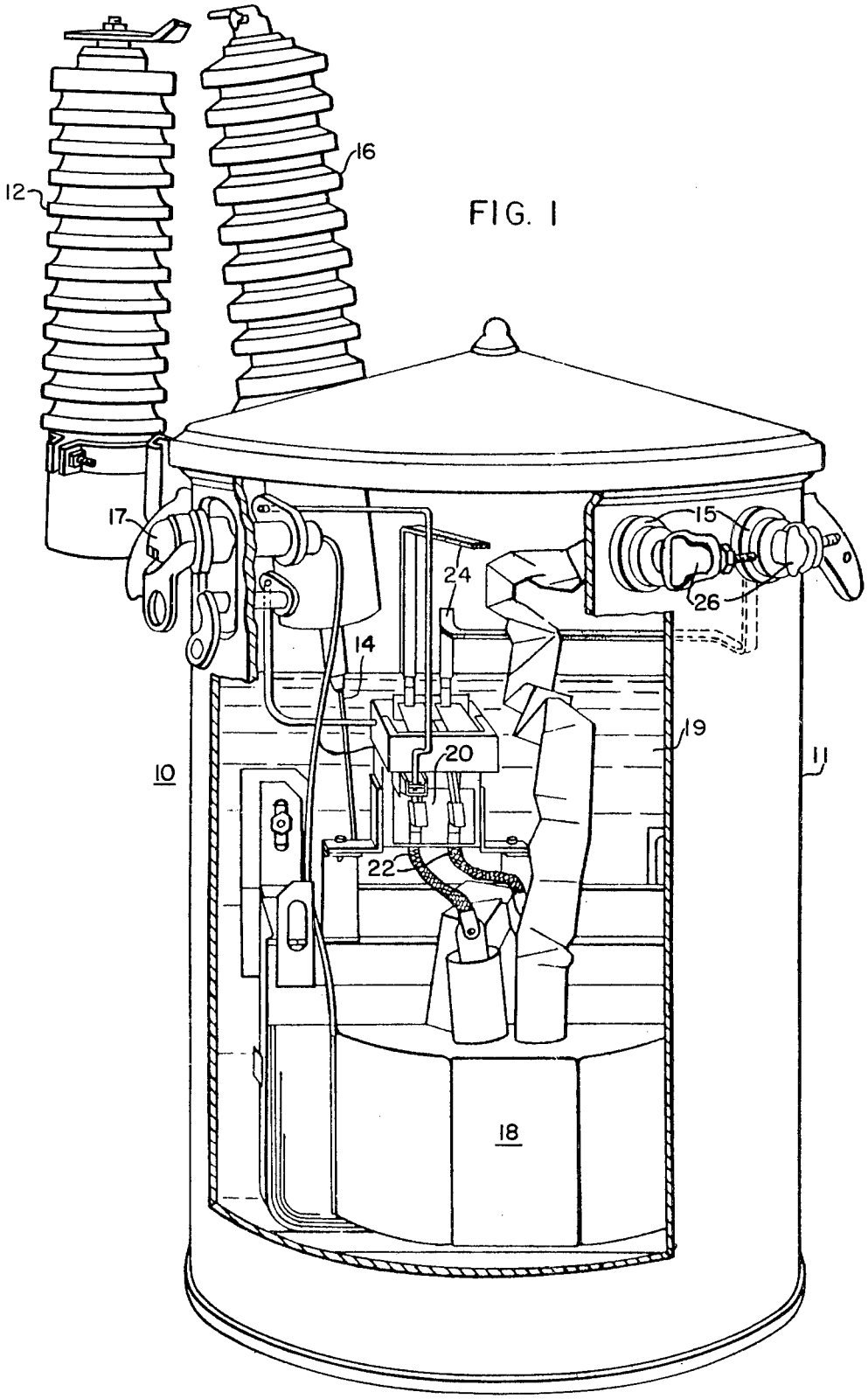
FIG. 1 is a perspective view of an oil filled distribution transformer containing a circuit breaker functioning in the oil environment.

Referring now to the drawings, and FIG. 1 in particular, there is shown a pole type completely self protected distribution transformer 10, including a circuit breaker 20 having parts dual coated according to the teaching of the present invention. The transformer 10 includes a housing, enclosure or tank 11 with a lightning arrestor 12 and a primary high voltage bushing 16 mounted thereon. Secondary bushings, such as the low voltage bushing 15, are attached to the enclosure 11 to which the transformer load is connected. A signal light 17 is mounted on the enclosure 11 and is electrically connected to the circuit breaker 20 to be actuated at a predetermined low overload.

The core and coil assembly 18 is secured inside the enclosure 11 with the circuit breaker 20 attached thereto. Required primary winding leads 14 extend from the core and coil assembly 18 to the appropriate high voltage bushings 16. The housing 11 is partially filled with an insulating liquid dielectric 19, such as transformer oil. The circuit breaker 20 and the core and coil assembly 18 are immersed in the insulating oil 19. Secondary connections 22, coming from the core and coil assembly 18, connect to input terminals on the circuit breaker 20. Conductors 24 connect the output terminals of the circuit breaker 20 to the low voltage bushings 15 mounted to the transformer tank 11. Appropriate loads can then be connected to the low voltage terminals 26 of the distribution transformer 10.

Figure 2:
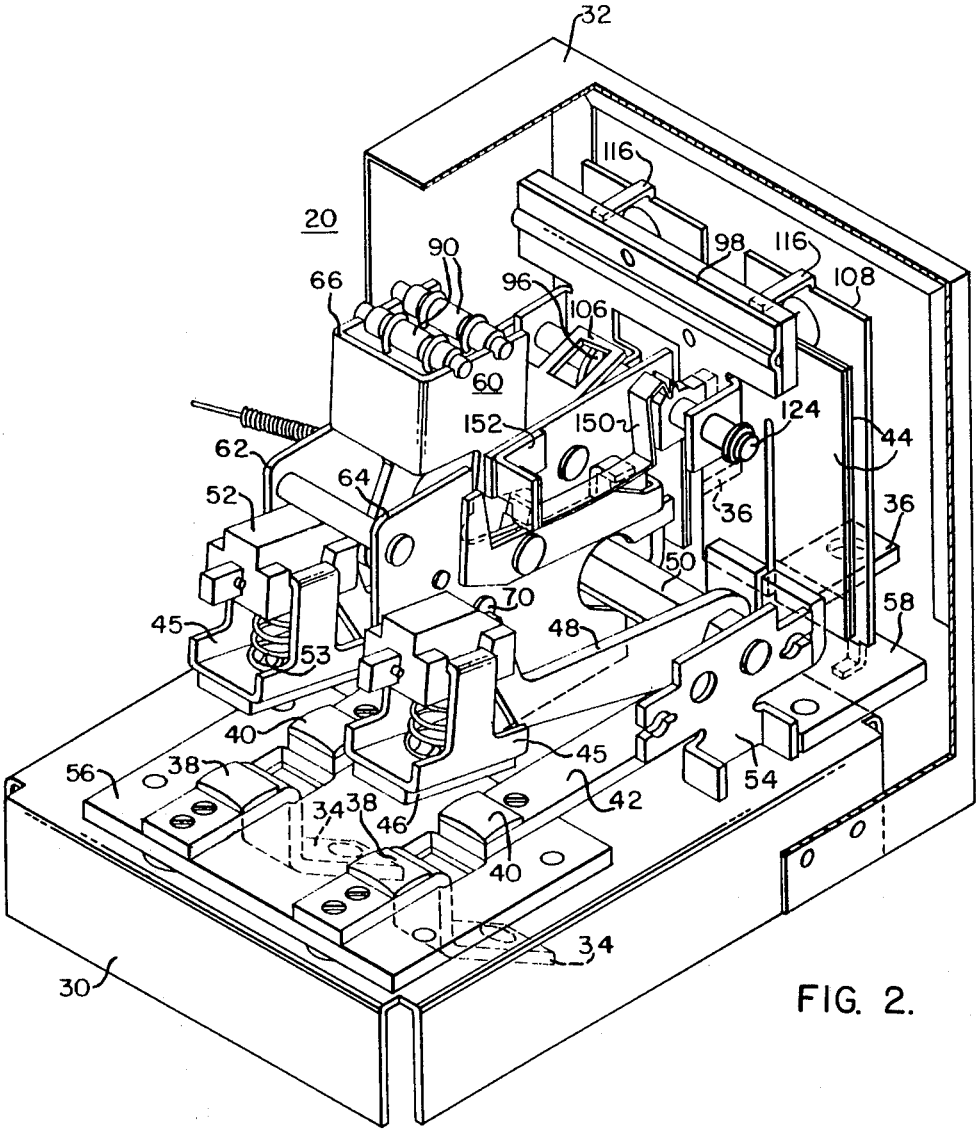
FIG. 2 is a perspective view of a secondary circuit breaker which may be used in a distribution transformer and containing metal members insulated and protected with the dual coating of this invention.

Referring now to FIG. 2, there is shown one possible embodiment of the circuit breaker 20. FIG. 2 shows an isometric view of a two pole circuit breaker utilizing a plurality of parts dual coated in accordance with the teaching of the present invention. The circuit interrupter 20 is mounted on a metallic base 30. A cover 32 is provided, partially surrounding the sensing and tripping elements of the circuit breaker 20 to provide protection during handling. A majority of these sensing and tripping members will be coated with the dual protective films of this invention. The relationship of these members to each other is described below.

Secondary leads 22 of the core and coil assembly 18 are attached to incoming circuit breaker terminals 34. Electrical conductors 24, disposed between the circuit breaker 20 and the low voltage transformer bushings 15, attach to circuit breaker 20 at terminals 36. Circuit breaker terminals 34 connect to stationary contacts 38. Circuit breaker terminals 36 connect to stationary contact 40 through electrical conductor 42 and bimetal 44. A bridging contact 46 is provided which, with the circuit breaker in the closed position, completes an electrical connection between stationary contacts 38 and 40. The bridging contact assembly 45 includes the movable bridging contact 46 attached to one portion thereof which, when the circuit interrupter is closed, completes an electrical connection between stationary contacts 38 and 40.

Each pole of the circuit breaker 20 is provided with an elongated contact arm 48 which at one end is rigidly secured to a through shaft 50. Shaft 50 connects the elongated contact arms 48 of all poles of the circuit interrupter 20 for simultaneous movement. The bridging assembly 45 is connected to the end of the elongated contact arm 48 opposite shaft 50. An insulating member 52 is provided at the end of contact arm 48, so that contact arm 48 is electrically insulated from the contact bridging assembly 45. A spring 53 is provided in contact assembly 45, to provide uniform contact pressure and proper seating of the bridging contact 46 on the stationary contacts 38 and 40.

Shaft 50 is rotatably supported by brackets 54. Stationary contacts 38 and 40 are electrically insulated from base plate 30 by insulating sheet 56, which is secured to base plate 30. Terminal 36 is connected to insulating sheet 58 which is rigidly secured to base plate 30. Electrical conductor 42 is insulated from base plate 30 by insulating sheets 56 and 58 and transformer oil 19, which fills the open spaces in the circuit interrupter 20 during normal operation. Conductor 42, which is generally L-shaped, has its short leg portion attached to one leg of bimetal 44. The other leg of bimetal 44 attaches to L-shaped terminal 36.

A single operating mechanism 60 is provided for operating all poles of the circuit interrupter 20. Operator 60 is connected to one of the elongated contact arms 48, and as this contact arm 48 is moved, in response to the positioning of the operator 60, the other elongated contact arm 48, connected through shaft 50, also responds. The single operating mechanism 60 for all poles is mounted on side plates 62 and 64 which are securely attached to support base 30. The operating mechanism comprises a U-shaped operating member 66, the two legs of which are connected to side plates 62 and 64 by pivots 70.

Figure 3:
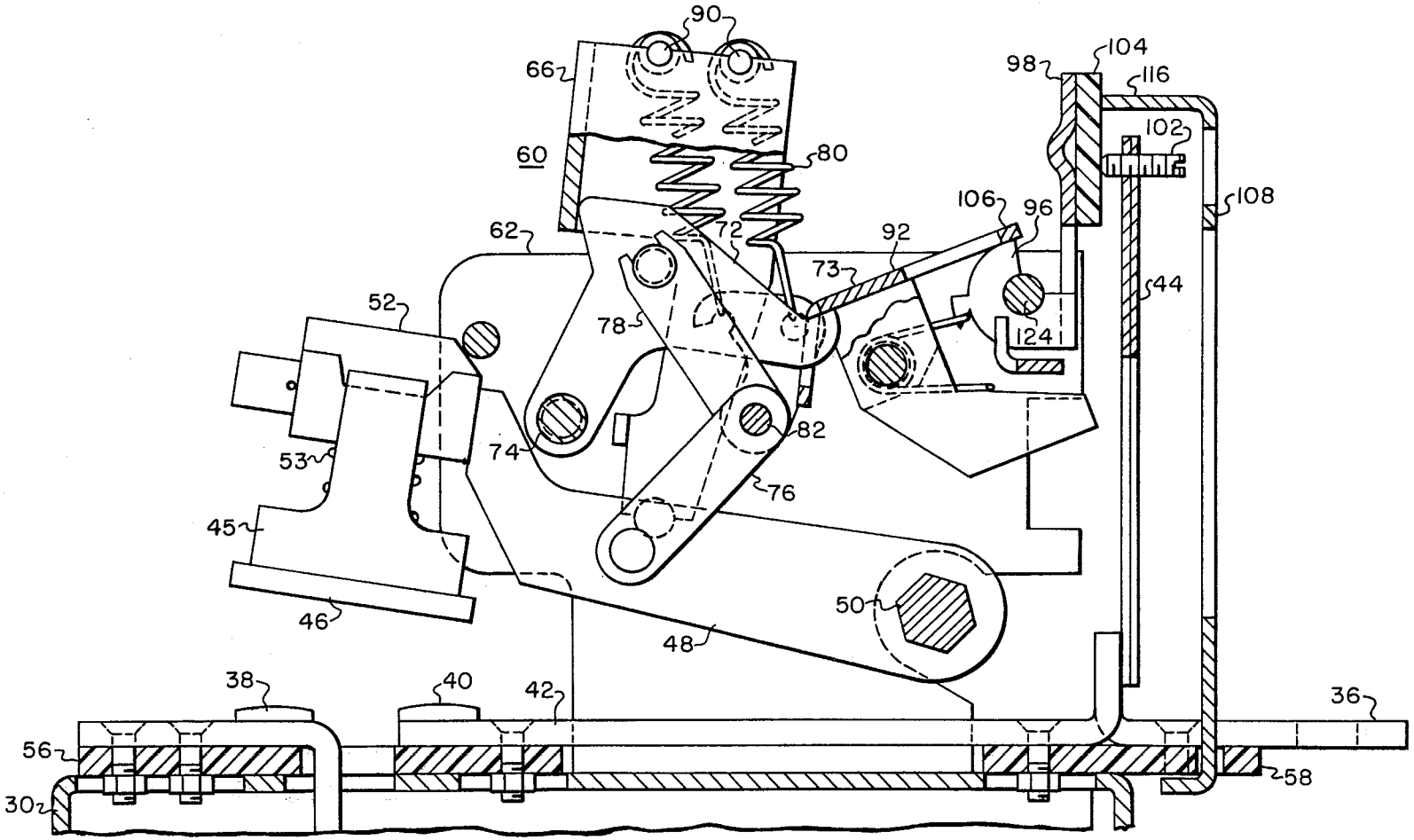
FIG. 3 is a side view of a portion of the circuit interrupter shown in FIG. 2 in the open position.

A primary latch 72 is provided, which as shown in FIG. 3, is pivotally connected to a shaft 74 disposed between side plates 62 and 64. A pair of toggle links 76 and 78 are provided, with one end of the toggle connected to the elongated contact arm 48 and the other end of the toggle connected to primary latch 72 and having multiple springs 80, connected between the knee of the toggle 82 and the top of U-shaped member 66 by support pins 90, for raising contact arm 48 with a snap action when primary latch 72 is released.

Each pole of the circuit breaker 20 is provided with an individual trip device including a current responsive bimetal element 44. The bimetal 44 is generally U-shaped. Adjusting screw 102 is disposed so as to contact an insulating portion 104 of trip bar mechanism 98 when bimetal 44 deflects.

Upon occurrence of, for example, an overload of less than 500% of normal rated current, the bimetal element is heated and deflects toward the trip bar mechanism 98. As the bimetal element deflects due to the flow of current therethrough, the edge of adjusted screw 102 engages the insulating sheet 104 attached to trip bar mechanism 98, rotating the trip bar 98 counterclockwise to a tripped position releasing secondary latch 92 and tripping open the circuit interrupter 20. The cam portion 96 of trip bar mechanism 98 moves, by rotation around shaft 124, from under the latching surface 106 to release the secondary latch 92. Primary latch 72 then rotates around pivot 74 moving the line of action of the springs 80 to the left of toggle pivot knee 82 causing the toggle 76–78 to collapse and opens the circuit interrupter 20 with a snap action.

Electromagnetic means is also provided to instantaneously trip the breaker. The electromagnetic trip means comprises a ferromagnetic member 108, disposed in proximity to bimetal element 44. A short arm 116 extends from electromagnetic trip member 108 towards the trip bar mechanism 98. Upon occurrence of a high overload current, of say for example, greater than 500% of normal rated current flowing through the bimetal 44, the electromagnetic trip member 108 is drawn towards bimetal 44 in response to the overload current whereupon arm 116 engages insulating sheet 104 of trip bar mechanism 98, rotating trip bar mechanism 98 to trip open the circuit interrupter 20.

Signal means is provided for indicating an overload condition that is not of sufficient magnitude to trip the breaker 20 open, but which indicates that the current in the circuit is approaching a dangerous overload condition or that a dangerous overload condition has existed and has cleared itself without tripping the breaker 20. The signal indicating means also indicates that the breaker 20 has been tripped open in response to an overload current. The signal means comprises a signal latch 150, which when unlatched, closes a signal contact on circuit breaker 20, lighting signal light 17 visible on the external transformer tank 11. Signal latch 150 is formed from an electrically conducting spring member which is supported by, but insulated from, bracket 152 attached to side plate 64.

As can be seen, most of the sensing, tripping and support members in the typical breaker described above operate in close tolerance contact with each other in the transformer oil environment. Many of these parts have been successfully dual coated with the compositions of this invention, for example: cover 32, brackets 54, supporting side plates 62 and 64, bridging contact assemblies 45, contact arms 48, shafts 50, 70 and 124, operating mechanism housing 60, arm 116, support pins 90 and a variety of latches and toggle links 72, 76 and 78 in the operating mechanism.

In coating the breaker members, the steel parts are initially washed as a pre-treatment step in an alkali cleaning solution such as disodium phosphate or tetrasodium pyrophosphate at about 60°C to 80°C for about 1 to 5 minutes. The parts are then washed in water at about 50°C to 70°C for about ½ to 2 minutes.

The parts are then contacted with an acidic, aqueous zinc phosphate or plain phosphate solution, generally by a dipping or spraying operation at a temperature and for a time, generally about 80°C to 95°C for about 2 to 5 minutes, effective to provide a base coating layer comprising zinc or iron phosphate between about 0.00001 to 0.0004 inch thick.

A wide variety of well known aqueous zinc phosphate solutions may be used. For example, an aqueous zinc phosphating bath may be prepared containing about 0.05 to 2 weight percent Zn, about 0.1 to 10 weight percent $PO_4$, about 1.0 to 1.5 weight percent of an auxiliary acid such as $HNO_3$ and about 0.5 to 2.5 weight percent $NaNO_2$ accelerator. Other useful accelerators, to reduce coating time, include nitrates and halides. The bath will have a total acidity of between about 18 to 21 points, i.e., 18–21 ml. of 1/10 N NaOH is required to neutralize a 10 ml. sample to a phenolphthalein end point. The pH of this bath is generally about 3 to 5. An iron phosphating bath will contain about 0.5 to 1.5 weight percent aqueous phosphoric acid, which will dissolve iron from the member to be coated and redeposit it as iron phosphate. It will generally also contain $NaNO_2$ accelerator. The pH of this bath is generally about 3–6. Zinc phosphating is preferred because it seems to provide better corrosion resistance and generally provide a denser coating.

This phosphating will provide a uniform, adherent, zinc or iron phosphate conversion coating weighing from about 50 to 300 mg./sq. ft. or about 50 to 100 mg./sq. ft. respectively. In both cases, the bath may contain standard accelerators, wetting and etching agents, etc. well known in the art. After phosphatizing, the parts may be washed in water at about 25°C to 40°C. THe phosphatized parts are then contacted with an acidic, aqueous solution of zinc chromate or zinc dichromate and sugar, generally by a dipping or spraying operation at a temperature and for a time, generally about 25°C to 32°C for about 2 to 5 minutes, effective to provide a coating between about 0.00001 to 0.0004 inch thick covering the zinc or iron phosphate coating. An aqueous chromatizing bath may be prepared containing about 0.5 to 5 weight percent zinc chromate or zinc dichromate and about 0.1 to 1.0 weight percent of a sugar such as maltose, cellobiose, lactose and sucrose. The pH of this is generally about 3 to 5.

This chromating will provide a uniform, adherent coating, comprising chromate or dichromate, along with a fraction of reduced chromate in the +3 chromium valence state, weighing from about 10 to 40 mg./sq. ft. It is believed that this solution reduces the water soluble portion of the phosphate coating and stabilizes the protective coating; chromates are deposited and a portion reduced to a +3 chromium compound. These compounds diffuse, interact, etch or interlock into the phosphatized metal surface and prevent flaking.

It is thought that the sugar used is effective to cause a small fraction, up to about 10%, of the chromates $(CrO_4)^{2-}$ or dichromates $(Cr_2O_7)^{2-}$ to be reduced to a lower valence state, probably from the +6 state to a trivalent (+3) chromium compound. It is to be understood that the term "comprising zinc chromate or zinc dichromate" will include the fractions present of these trivalent (+3) chromates which are baked and dried reaction product of the chromates and sugar. During the drying step, the chromate, dichromate and +3 valence state chromium is thought to diffuse into, etch, or interconnect with the zinc phosphate surface providing a highly adherent moisture resistant dual coating. The phosphate and chromate interface is exceptionally well bonded together.

Figure 4:
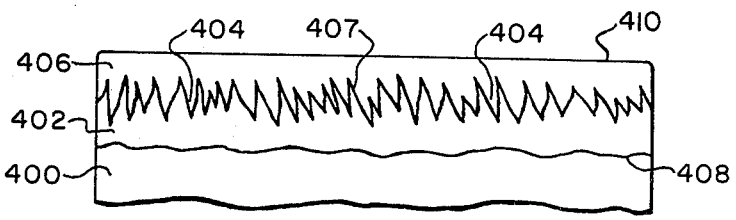
FIG. 4 shows, in magnified cross-sectional view, the interlocking interface of the dual coating of this invention.

As shown in FIG. 4 of the drawings, the iron member 400 has a very rough first layer comprising zinc or iron phosphate 402 covering the iron surface. The smoother covering layer 406, comprising zinc chromate and/or zinc dichromate and also containing a fraction of reduced chromate compounds in the +3 chromium valence state, has interlocking incursions in the body of the phosphate layer shown as the needle-like root formations 404 at the wedgelike phosphate-chromate interface 407. The thickness of each coating is measured from the iron surface 408 or the air surface 410 to the top and bottom of the wedge formations of each layer.

EXAMPLE 1

Toggle links, similar to that shown as number 76 in FIG. 3 of the drawings, were coated as follows: 300 steel links 1/16 inch × 1 inch × ½ inch, having one 3/16 inch diameter hole at each end were placed in a stainless steel wire mesh basket. These were dip washed in disodium phosphate alkaline cleaner at 75°C for 3.5 minutes. Following this pretreatment, the links were rinsed in water at 65°C for 1 minute. The links were then dipped in an acidic, aqueous zinc phosphate solution, maintained at a temperature of 88°C ± 5°C for 3.5 minutes. During this time the wire mesh basket was agitated to assure good metal-phosphate contact. The phosphate solution contained about 0.31 weight percent Zn, about 0.81 weight percent $PO_4$ and about 1.23 weight percent $HNO_3$ (the solution is sold commercially by Parker Chemical Co. under the trade name Bonderite 880). It also contained 5.4 ml. of sodium nitrite accelerator per 10 gallons of phosphate solution.

The links were removed and rinsed in water at 27°C, and then dipped in an acidic, aqueous solution of zinc dichromate and sugar, maintained at a temperature of 30°C ± 2°C for 3.5 minutes. During this time the wire mesh basket was agitated to assure good metal-solution contact. The solution contained 4.4 parts by weight of zinc dichromate solution containing 31 weight percent solids (sold commercially by Pennwalt Corp. under the trade name Hinac 'A'), 0.4 parts by weight of sugar solution containing 67 weight percent sugar solids (sold commercially by Pennwalt Corp. under the trade name Hinac 'R1') and 100 parts water, i.e., about 1.5 weight percent zinc dichromate and about 0.25 weight percent sugar in solution.

The links were then drip dried, removed from the basket, and baked in an oven at 210°C ± 5°C until the parts were dry. Forty-five of the toggle links were placed in a glass container, with 600 grams of refined mineral oil of the type commonly used in transformers. The oil contained no additives, free moisture, inorganic acid or free sulfur. The oil had a dielectric strength (0.1 inch gap) of 30 KV min., a power factor (60 cycle, 25°C) of 0.05% max., a viscosity (SSU, 37.8°C) of 62 sec., and a specific gravity at 15.5°C of 0.898. The container with oil and immersed links was placed in a convection oven, maintained at a temperature of 105°C for 7 days, to simulate an extreme oil transformer environment. After removal of the coated toggle links the oil was tested for color, interfacial tension, dielectric strength and power factor versus unused oil.

The measurements on the oil showed that the used oil was still an excellent insulator, and not affected or degraded in any way by the coating on the toggle links. The toggle links were also inspected and the coating was found not to have been degraded in any way by the hot transformer oil. Thus, the coated links would maintain their dimensional tolerances in a hot transformer oil environment.

The links were shipped to a seacoast plant in Mayaguez, Puerto Rico, where the air has a high humidity, 80–98%, and has a particularly corrosive effect on steel parts. They were stored for about 6 weeks and showed no sign of rust. Two links per breaker were then used as toggle links in simplified versions of the circuit breaker shown in FIG. 2 of the drawings, along with other sensing, tripping and supporting members which had been tin plated. These circuit breakers were stored in Puerto Rico for a short time and then shipped to Georgia, where a number of them were installed in oil filled transformers, similar to that shown in FIG. 1 of the drawings. The phosphate-dichromate coated parts did not adversely affect transformer performance in any way.

The dimensional tolerances of the toggle links in the breakers were excellent. The toggle links had a zinc phosphate layer about 0.00005 inch maximum thickness, with a jagged highly bonded interface with its coating layer comprising zinc dichromate about 0.00005 inch maximum thickness, also containing a small fraction of reduced chromium in the form of +3 chromium valence state compounds. The total dual coating thickness was about 0.0001 inch. These phosphate-dichromate coated parts could be easily welded without degrading the coating, did not attract dust, and did not appreciably affect the coefficient of friction of the steel. Moreover, the coating process was ½ as expensive as tin plating.

In a similar fashion, other parts for a circuit breaker which would operate in an oil environment were dual coated by the method described above. These parts included cover 32, brackets 54, supporting side plates 62 and 64 bridging contact assemblies 45, contact arms 48, shafts 50, 70, and 124, operating mechanism housing 60, arm 116, support pins 90 and latches and toggle switches 72, 76 and 78 shown in FIG. 2 and FIG. 3 of the drawings. These dual phosphate-dichromate coated parts, having a total protective build of about 0.0001 inch, were tested in hot transformer oil as described above. Neither the transformer oil nor the coating were degraded in any way.

We claim:

1. A transformer, having a housing, with a circuit breaker switchable between an open position wherein the electrical connections through the transformer are open and a closed position wherein the electrical connections through the transformer are closed disposed within the housing and immersed in an insulating liquid dielectric; the circuit breaker comprising metallic sensing, tripping and supporting members, wherein a plurality of said members are coated with a dual protective film comprising a first phosphate layer selected from the group consisting of zinc phosphate and iron phosphate about 0.00001 to about 0.0004 inch thick, covered by an outside layer comprising a chromate selected from the group consisting of zinc chromate, zinc dichromate and mixtures thereof about 0.00001 to about 0.0004 inch thick, said protective film being resistant to the contacting liquid dielectric.

2. The transformer of claim 1 wherein the contacting liquid dielectric is refined mineral oil and the coated metallic members are steel.

3. The transformer of claim 2 wherein the interface of the phosphate and chromate layers contains interlocking formations.

4. The transformer of claim 2 wherein the chromate layer also contains a fraction of chromium compounds having a +3 chromium valence state.

5. The transformer of claim 2 wherein the circuit breaker comprises:

a pair of stationary contacts;

bridging contact means movable between an open position spaced from said pair of stationary contacts and a closed position engaging said pair of said stationary contacts completing a series circuit therethrough;

spring biasing means biasing said bridging contact means away from said pair of stationary contacts;

latch means movable between a latched position holding said bridging contact means in engagement with said pair of stationary contacts and an unlatched position allowing said bridging contact means to move away from said stationary contact means in response to said spring bias means; and bimetal actuating means connected on the circuit interrupter so that transformer current flows therethrough and being cooperatively associated with said latch means to move said latch means to an unlatched position when current flow exceeds a trip level.

6. A circuit breaker operating in an insulating liquid dielectric environment, switchable between an open position and a closed position comprising metallic sensing, tripping and supporting members; wherein a plurality of the members are coated with a dual protective film comprising a first phosphate layer selected from the group consisting of zinc phosphate and iron phosphate about 0.00001 to about 0.0004 inch thick, covered by an outside layer comprising a chromate selected from the group consisting of zinc chromate, zinc dichromate and mixtures thereof about 0.00001 to about 0.0004 inch thick, said protective film being resistant to the contacting liquid dielectric.

7. The circuit breaker of claim 6 wherein the contacting liquid dielectric is refined mineral oil and the coated metallic members are steel.

8. The circuit breaker of claim 7 wherein the interface of the phosphate and chromate layers contains interlocking root formations.

9. The circuit breaker of claim 7 wherein the chromate layer also contains a fraction of chromium compounds having a +3 chromium valence state.

10. The circuit breaker of claim 7 comprising:

a pair of stationary contacts;

bridging contact means movable between an open position spaced from said pair of stationary contacts and a closed position engaging said pair of said stationary contacts completing a series circuit therethrough;

spring biasing means biasing said bridging contact means away from said pair of stationary contacts;

latch means movable between a latched position holding said briding contact means in engagement with said pair of stationary contacts and an unlatched position allowing said bridging contact means to move away from said stationary contact means in response to said spring bias means; and bimetal actuating means connected on the circuit interrupter so that transformer current flows therethrough and being cooperatively associated with said latch means to move said latch means to an unlatched position when current flow exceeds a trip level.

* * * * *